United States Patent [19]

Enomoto et al.

[11] 4,035,247

[45] July 12, 1977

[54] METHOD OF MANUFACTURING A REFLECTING MIRROR

[75] Inventors: Toshio Enomoto; Seiji Muto, both of Tokyo, Japan

[73] Assignee: Toyo Kokan Kabushiki Kaisha, Japan

[21] Appl. No.: 647,779

[22] Filed: Jan. 9, 1976

[30] Foreign Application Priority Data

Mar. 31, 1975 Japan ..... 50-38812

[51] Int. Cl.[2] ..... C25D 5/36; C25D 7/08; C25D 5/14

[52] U.S. Cl. ..... 204/19; 204/34; 204/41

[58] Field of Search ..... 204/34, 40, 19, 7, 41

[56] References Cited

U.S. PATENT DOCUMENTS

| | | | |
|---|---|---|---|
| 915,415 | 3/1909 | Cowper-Coles | 204/19 |
| 2,285,548 | 6/1942 | Wesley | 204/34 |
| 2,557,823 | 6/1951 | Holbrook | 204/34 |
| 2,878,172 | 3/1959 | Scavullo | 204/34 |
| 3,186,925 | 6/1965 | Kushner | 204/40 |
| 3,338,803 | 8/1967 | Di Bari | 204/40 |

*Primary Examiner*—T. M. Tufariello
*Attorney, Agent, or Firm*—Robert E. Burns; Emmanuel J. Lobato; Bruce L. Adams

[57] ABSTRACT

A method of manufacturing a reflecting mirror is proposed which includes a double nickel layer plated on a stainless steel sheet as a base material. After buffing, the base material is immersed in a 4 to 9% solution of hydrochloric acid to remove any oxide thereon, thus performing a pre-treatment step. The method also features a pre-plating step which forms an initial plated nickel layer on the surface of the base material, using a bath composition comprising 150 to 300g/*l* of nickel chloride and 3.6 to 36g/*l* of hydrochloric acid. The method also includes a bright nickel plating step which employs a standard Watts bath.

3 Claims, No Drawings

METHOD OF MANUFACTURING A REFLECTING MIRROR

BACKGROUND OF THE INVENTION

The invention relates to a method of manufacturing a reflecting mirror from a stainless steel sheet as a base material, and more particularly to a method of manufacturing a reflecting mirror having a double nickel layer plated on the surface of the stainless steel sheet.

A metallic reflecting mirror which employs aluminium as a base material is known since old. The mirror is formed by electropolishing the aluminium surface to make it lustrous, and forming a transparent oxide film thereon to provide a corrosion resistance and abrasion resistance. Such mirror can be manufactured in a number of processes using different electrolytes or electrolytic steps, but almost all of these processes employ an alkaline electrolyte, so that any impurity such as iron or copper in the base material is left on the surface thereof without being precipitated into the electrolyte. As a result, the base material must be a high purity aluminium in excess of 99.97%. Still, it is difficult to obtain a uniformly bright surface, and the soft nature of the base material involves the essential disadvantage of being vulnerable to damage, which renders it inadequate for industrial purposes which require a working of the product into a desired configuration or size.

There has been some attempt to manufacture a reflecting mirror from a stainless steel sheet as a base material, a view of the workability and strength which it affords. However, the prior proposal has been a mere buffing of the surface of the stainless steel sheet, and the resulting product had a poor brightness and also exhibited a substantial amount of distortion of image, which prevented it practical use except for the merit of inexpensiveness. Since the success of removing the passivity of the surface of stainless steel, techniques have been proposed to a plate a variety of metals on its surface. By way of example, after the pre-treatment, a bright nickel layer can be plated onto the surface of the stainless steel, using a standard Watts bath or Weisberg bath. However, the resulting plated layer exhibited a blackish tint which reflects the tone of the base material, and thus was wanting in brightness. In addition, with the proposed techniques, the pre-treatment included an electrocleaning of the steel surface and an activation by a cathodic treatment in sulfuric or hydrochloric acid. The activation resulted in a reduced adherence of a nickel layer which is subsequently plated, and thus the plated layer is susceptible to exfoliation during the working of the product, particularly when it is bent into a given configuration.

Therefore, it is an object of the invention to provide a method of manufacturing an inexpensive reflecting mirror having a bright mirror surface which exhibits a high gloss and is free from distortion of image.

It is another object of the invention to provide a method of manufacturing a reflecting mirror having a double nickel layer plated on the surface of a stainless steel sheet and having a close adherence thereto, thus enhancing the workability.

It is a further object of the invention to provide a method of manufacturing a reflecting mirror from a stainless steel sheet as a base material, which can be reduced to practice with a simple apparatus.

SUMMARY OF THE INVENTION

The method according to a invention is characterized by the pre-treatment step which activates the surface of the stainless steel sheet, and an initial nickel plating step for forming a double nickel layer plated onto the surface of the sheet. In accordance with the invention, the pre-treatment of the surface of the stainless steel sheet avoids a complex electrocleaning or cathodic treatment usually employed in the prior art practice, and primarily resides in a simple immersion in hydrochloric acid. In connection with this pre-treatment, the initial step of the two step nickel plating employs an amount of hydrochloric acid which is reduced to approximately one quarter to one eighth that used in the conventional strike nickel plating, together with nickel chloride.

DESCRIPTION OF CARRYING OUT THE NEW METHOD

The preferred way of carrying out the method of manufacturing a reflecting mirror according to the invention comprises four steps, which will be individually described below.

1. Pre-treatment of the surface of stainless steel sheet

The stainless steel which is used in the present invention may be either 13-chromium steel or austenitic such as 18–8 steel. It is chosen in accordance with the requirements for workability, weldability and mechanical strength, imposed by the intended use of the reflecting mirror. The sheet thickness may range from 0.3 to 2.0 mm, for example. Initially, the stainless steel sheet is buffed, followed by a degreasing with a known organic solvent such as trichloroethylene or perchloroethylene. Subsequently, in order to activate it, as noted, it is immersed into a 5 to 9% solution of hydrochloric acid at room temperature for a period from 30 seconds to 2 minutes. This enables a uniform removal of a thin chromium or nickel oxide having a thickness ranging from 5 to 20 microns and which firmly adheres to the surface of the steel sheet. By experiments, it is found that above 9% for the concentration of the solution of hydrochloric acid, the dissolution of the oxide film tends to become non-uniform, whereas below 4%, a complete removal cannot be assured. Subsequently, the stainless steel sheet is throughly rinsed in water, whereby the pre-treatment is finished.

Evaluating the immersion into sulfuric acid or the immersion into a concentrated nitric acid which has been employed in the prior art to remove the passivity of the stainless steel or the activation thereof, the former results in a poor adherence of the subsequently plated nickel while the latter degrades the gloss of the plated nickel layer and also involves a critical control over the immersion, both of which is not favorable.

2. Pre-plating of nickel

After the pre-treatment, the stainless steel sheet is immediately subjected to the pre-plating, which is carried out by using a plating bath having the composition given below.

| | |
|---|---|
| Nickel chloride | 150 to 300g/l |
| Hydrochloric acid | 3.6 to 36g/l |

The plating is carried out under the following conditions:

| | |
|---|---|
| pH | 1 to 3 |
| Current density | 1 to 2A/dm² |
| Temperature | room temperature |
| Time period | 5 to 30 minutes |

A feature of the pre-plating resides in a proportion of hydrochloric acid in the overall bath composition which is substantially reduced as compared with the usual strike plating. In a typical strike plating, hydrochloric acid is used in an amount from 80 to 120g/l together with 240g/l of nickel chloride. As compared with such value, the proportion of hydrochloric acid used in the present invention is reduced to one quarter to one eighth such value. In addition, a current density higher than the normal current density, for example, from 5 to 20A/dm², is passed for a short time interval in the strike plating, but the pre-plating of nickel according to the present invention employs a different or substantially reduced current density. The choice of such concentration and current density is essential in order to manufacture a reflecting mirror having a bright tint and a high gloss. The pre-plating step achieves a nickel layer of a thickness from 5 to 15 microns, and a bright nickel plating is applied to this layer as will be described below.

3. Bright nickel plating

A known standard Watts bath is used for the bright nickel plating.

| | |
|---|---|
| Bath composition: | |
| Nickel sulfate | 240g/l |
| Nickel chloride | 45g/l |
| Boric acid | 30g/l |
| Plating conditions: | |
| pH | 4.2 to 4.5 |
| Current density | 2 to 4A/dm² |
| Temperature | 45 ± 5° C |
| Time period | 15 to 20 minutes |

The brightener used may comprise 1 to 5ml/l of 10% diol sodium sulfonate and 0.1 to 1ml/l of 1% gelatine solution.

As a result of this plating step, a bright nickel layer is obtained which has a high gloss and a thickness on the order of 10 to 30 microns. It is desirable that control be exercised over the concentration of the nickel salt and the brightener as well as the values of pH.

4. Surface plating

The stainless steel sheet which has been subjected to the bright plating has sufficient capability for its practical use as a reflecting mirror. However, it is desirable to apply a surface plating in order to further increase the gloss and to provide the abrasion resistance and, if desired, a decorative effect. Several platings can be employed depending on the intended use.

| | |
|---|---|
| (a) Chromium plating with Sargent bath | |
| Bath composition: | |
| Chromic anhydride | 250g/l |
| Sulfuric acid | 2.5g/l |
| Plating conditions: | |
| Current density | 15 to 30A/dm² |
| Temperature | 45 ± 5° C |
| Time period | 5 to 15 minutes |

As a result of such plating, there is obtained a final product which is covered by a glossy and abrasion resistant chromium layer which is plated to a thickness of 1 to 3 microns. Because of the increased abrasion resistance, the reflecting mirror which is coated with the chromium layer is suitable for use in various industrial purposes. Where the decorative effect is more desired than mechanical strength, as with a lamp shade, one of the following platings (b) to (d) may be preferred.

| | |
|---|---|
| (b) Golden plating | |
| Bath composition: | |
| Gold potassium cyanide (Au 67.5%) | 3.8g/l |
| Potassium cyanide | 15g/l |
| Plating conditions: | |
| Current density | 2 to 3A/dm² |
| Temperature | 60 to 70° C |
| Time period | 5 to 20 seconds |
| Anode | carbon or gold |
| (c) Green gold plating | |
| Bath composition: | |
| Gold potassium cyanide | 3.8g/l |
| Silver cyanide | 0.8 to 1.5g/l |
| Sodium cyanide | 4.5g/l |
| Plating conditions: | |
| Current density | 1 to 2A/dm² |
| Temperature | 40 to 50° C |
| Anode | carbon, stainless steel or silver |
| (d) Silver plating | |
| Bath composition: | |
| Silver cyanide | 40g/l |
| Sodium cyanide | 120g/l |
| Sodium carbonate | 15g/l |
| Plating conditions: | |
| Current density | 1 to 2A/dm² |
| Voltage | 2 to 3V |
| Anode | silver or carbon |

A reflecting mirror obtained according to a preferred Example of the invention exhibited a gloss of Gs (60°) = 638 as referenced to a black glass plate having Gs (60°) = 93, and such gloss is by 20% higher than that of a reflecting mirror prepared from 18–8 stainless steel by the buffing technique which exhibits Gs (60°) = 530. When the plane reflecting mirror prepared in accordance with the invention is worked into a concave or convex mirror, no exfoliation of the plated layer or layers has been observed, demonstrating the workability of the reflecting mirror.

A preferred Example of the invention will be given below.

EXAMPLE

1. Pre-treatment

Austenitic 18–8 stainless steel sheet having a thickness of 0.3 mm is buffed with an emery wheel of from 80 to 320 meshes, and then glazed with a finish buff formed by a cloth and wax. The steel sheet is degreased with trichloroethylene as solvent, and immersed 8% solution of hydrochloric acid for one minute.

2. Pre-plating of nickel

The following nickel bath is used:

| | |
|---|---|
| Nickel chloride | 220g/l |
| Hydrochloric acid | 7ml/l |
| Plating conditions: | |
| pH | 2 |
| Current density | 2A/dm² |
| Temperature | room temperature |
| Time period | 5 minutes |

A nickel layer is plated to a thickness of 5 microns.

(3) Bright nickel plating

-continued

| | |
|---|---|
| Standard Watts bath is used. | |
| Nickel sulfate | 240g/l |
| Nickel chloride | 45g/l |
| Boric acid | 30g/l |
| A brightener comprises 1ml/l of 10% diol sodium sulfonate and 0.5ml/l of 1% gelatine solution. | |
| Plating conditions: | |
| pH | 4.2 |
| Current density | 3A/dm² |
| Temperature | 45 ± 5° C |
| Time period | 20 minutes |
| A bright nickel layer is plated to a thickness of 15 microns on the previously plated nickel layer. | |
| (4) Surface plating | |
| Plating bath composition: | |
| Chromium anhydride | 250g/l |
| Sulfuric acid | 2.5g/l |
| Plating conditions: | |
| Current density | 20A/dm² |
| Temperature | 45 ± 5° C |
| Time period | 5 minutes |
| A chromium layer is plated to a thickness of 1.3 microns. | |

Having described the invention, what is claimed is:

1. A method of manufacturing a mirror, comprising buffing a surface of stainless steel sheet, of the group comprising 13-chromium steel and austenitic steel, such as 18–8 steel;

activating the buffed surface of the sheet by immersing it into a 4 to 9% solution of hydrochloric acid, at room temperature, for a period of 30 seconds to 2 minutes, to remove from the buffed surface any film of oxide present thereon;

rinsing the activated sheet surface in water to remove any remaining portions of the solution;

pre-plating on the activated surface a nickel layer by immersing the sheet in a bath containing 3.6 to 36 g/l of hydrochloric acid and 150 to 300 g/l of nickel chloride, at room temperature, for a pre-plating period of 5 to 30 minutes, with an electric current at a density of 1 to 2 A/dm²; and plating on the pre-plated surface a bright nickel layer by immersing the sheet in a Watts bath;

whereby a mirror is produced which is characterized by high strength, workability, gloss, and brightness, by low distortion, and by strong adherence of the nickel layers to the stainless steel sheet.

2. A method according to claim 1, including the additional step of plating chromium on the bright nickel layer with a standard Sargent bath to form a surface layer.

3. A method according to claim 1, including the additional step of applying on the bright nickel layer a decorative plating of the group comprising golden, green gold and silver plating to form a surface layer.

* * * * *